US008498747B2

(12) United States Patent
Feldstein

(10) Patent No.: US 8,498,747 B2
(45) Date of Patent: Jul. 30, 2013

(54) DRAPERY ASSEMBLY WITH A POWERED CARRIER

(75) Inventor: George Feldstein, Cresskill, NJ (US)

(73) Assignee: Crestron Electronics Inc., Rockleigh, NJ (US)

( * ) Notice: Subject to any disclaimer, the term of this patent is extended or adjusted under 35 U.S.C. 154(b) by 292 days.

(21) Appl. No.: 12/982,189

(22) Filed: Dec. 30, 2010

(65) Prior Publication Data

US 2012/0173024 A1 Jul. 5, 2012

(51) Int. Cl.

| | |
|---|---|
| ***G05B 15/00*** | (2006.01) |
| ***G05D 1/02*** | (2006.01) |
| ***G05D 3/00*** | (2006.01) |
| ***E06B 9/36*** | (2006.01) |
| ***E06B 9/32*** | (2006.01) |
| ***E06B 9/26*** | (2006.01) |
| ***E05F 11/00*** | (2006.01) |
| ***E05F 15/00*** | (2006.01) |
| ***A47H 1/00*** | (2006.01) |

(52) U.S. Cl.

USPC ..... 700/275; 318/16; 318/17; 318/467; 160/167 V; 160/168.1 P; 160/168.1 V; 160/174 V; 160/176.1 P; 160/178.1 V; 160/188; 160/201; 160/214; 160/310

(58) Field of Classification Search

USPC ..... 700/275; 318/16, 17, 283, 286, 466, 318/467; 160/1, 7, 10, 84.01, 84.02, 130, 160/166.1, 167 R, 167 V, 168.1 R, 168.1 V, 160/168.1 P, 174 R, 176.1 P, 178.1 V, 181, 160/188, 201, 214, 309, 310, 405, 174 V

See application file for complete search history.

(56) References Cited

U.S. PATENT DOCUMENTS

| | | | | |
|---|---|---|---|---|
| 4,062,146 | A | 12/1977 | Grossman | |
| 4,437,506 | A | 3/1984 | Ogita | |
| 4,471,275 | A * | 9/1984 | Comeau | 318/286 |
| 5,371,447 | A | 12/1994 | Boss | |
| 5,467,808 | A * | 11/1995 | Bell | 160/168.1 P |
| 5,676,189 | A | 10/1997 | Zeeb | |
| 5,729,103 | A * | 3/1998 | Domel et al. | 318/283 |
| 6,085,825 | A * | 7/2000 | Swink et al. | 160/188 |
| 6,283,190 | B1 * | 9/2001 | Hu et al. | 160/84.02 |
| 6,755,230 | B2 * | 6/2004 | Ulatowski et al. | 160/84.02 |
| 7,832,052 | B2 * | 11/2010 | Vrielink | 16/87.4 R |
| 2006/0000558 | A1 * | 1/2006 | Fennell | 160/7 |
| 2007/0056697 | A1 * | 3/2007 | Chen | 160/310 |
| 2009/0283225 | A1 * | 11/2009 | Luger | 160/310 |
| 2011/0253320 | A1 * | 10/2011 | Baugh et al. | 160/127 |

FOREIGN PATENT DOCUMENTS

DE 19605273 A1 * 8/1997

* cited by examiner

*Primary Examiner* — Crystal J Barnes-Bullock

(74) *Attorney, Agent, or Firm* — Crestron Electronics Inc.

(57) ABSTRACT

A drapery assembly extends and retracts a drape with a powered carrier. The carrier receives both a power signal and a command signal from a controller via an electrically powered surface of a drapery rod. The carrier supports a portion of the drape and moves linearly along the length of the drapery rod in response to the control signal.

18 Claims, 8 Drawing Sheets

DRAPERY ASSEMBLY WITH A POWERED CARRIER

BACKGROUND OF THE INVENTION

1. Technical Field

The present invention generally relates to window coverings and more specifically to drapery assemblies.

2. Background Art

Drape assemblies are used to cover openings or fixtures such as windows, screens or stages and are well known in the prior art. FIG. 1 shows an illustrative drapery assembly 10 covering a window 11. Drape assemblies generally comprise a drapery rod 12 mounted on a surface from which a drape 13, often pleated fabric, is connected via a series of carriers. The carriers may simply be rings hanging on the drapery rod 12 or alternatively, a carrier configured to slide along the length of the drapery rod 12. The drape 13 is hung from each carrier by a connector, such as a hook or a clamp. A primary carrier 14 is attached to the foremost end of each drape and secondary carriers 15 are distributed along the length of the drape 13.

Large windows may be covered by multiple drapes if necessary. However, drape assemblies most commonly fall into one of two categories: single drape assemblies or double drape assemblies. Single drape assemblies include one drape which covers the entire opening. Double drape assemblies include two drapes, each covering half the opening. Each drape in a double drape assembly is attached to a primary carrier located at the foremost edge which closes toward and opens away from the center of the opening. The two primary carriers are usually mechanically synchronized to move in unison (i.e. both are opening or both are closing).

Drape assemblies may be controlled both manually and mechanically. The simplest method involves pulling a wand attached at the foremost end of the drape or pulling the drape itself. The secondary carriers are then pushed along the drapery rod by the primary carrier or pulled along the drapery rod by tension in the drape. Although this is a simple, low-cost option, there are significant disadvantages with opening and closing drapes in this manner. Manually pulling the drape requires someone to walk the length of the opening. Additionally, it may be impractical to close large drapes with a wand due to the weight of the drapes and the force required to overcome friction in a large number of secondary carriers. Finally, the tension in the drape required to move the secondary carriers along the drapery rod 12 when closing causes damage or premature wear in the drape.

Pulley operated drape assemblies, both manual and mechanical, are among the most popular types of drape assemblies employed. Most commonly, the primary carrier is attached to a drive cord that is guided inside the drapery rod. At each end of the drapery rod, the drive cord is normally guided through a free-wheel pulley at the non-drive end and through a drive pulley at the drive end. The drive cord may be manually operated or mechanically driven.

Motor powered drapery assemblies are known in either a direct drive version or an indirect drive version. Prior Art FIG. 1 shows a direct drive version of a motor driven pulley. In a direct drive version, the motor 16 is directly connected to the drapery rod 12 and the rotation power is transmitted to the drive cord 17 or belt via a gear mechanism. In indirect drive versions the motor is normally mounted at some distance below the drapery rod 12 and a vertical loop of the drive cord that extends below the drapery rod 12 is guided through a pulley attached to the motor. Indirect motors are more commonly used to retrofit manual cord driven drapery assemblies.

Those skilled in the art will recognize that despite their popularity there are significant disadvantages associated with pulley operated drape assemblies. Tension in the drape causes unnecessary wear and damage. The motors used are hard to conceal and are often noisy and distracting. Additionally, such systems are inefficient due to the indirect application of force and the friction of the pulleys and extra components. Finally, the friction and slippage in the pulleys causes the motion of the drape to be jerky and intermittent.

It is known in the prior art to directly drive the primary carrier of a drapery assembly with a motor mounted on the primary carrier. Zeeb (U.S. Pat. No. 5,676,189) discloses such a motorized drapery track assembly. The motorized drapery track assembly includes a motorized drive wheel receiving electric power through wires interconnected to the drapery trollies and controlled through external switches. Alternatively, the motorized drive wheel may be remotely controlled and receive electric power though a battery. The motorized drapery track assembly disclosed in Zeeb is particularly suited for traversing a curved track.

Those skilled in the art will recognize certain disadvantages to the prior art drapery track assembly. Routing wires along the length of the drapery rod is not aesthetically pleasing. This power and communication scheme may potentially cause mechanical malfunction as well. Wires routed in such a manner may easily become tangled in the drapery assembly components or surrounding environment. Even in the battery powered and remote controlled embodiment of the drapery track assembly, there are significant limitations. Control options are limited. Only the primary carrier may be controlled from the external switch and only by visually observing the moving primary carrier.

SUMMARY OF THE INVENTION

It is to be understood that both the general and detailed descriptions that follow are exemplary and explanatory only and are not restrictive of the invention.

DISCLOSURE OF INVENTION

Accordingly, a need exists for an improved drapery assembly for extending and retracting a drape. The embodiments of the present invention provide these advantages and others not specifically mentioned above but described in the sections to follow.

According to a first aspect, the present invention provides a drapery assembly for extending and retracting a drape. The drapery assembly includes a drapery rod comprising an electrically powered surface, a carrier held in movable linear mechanical restraint with the drapery rod, and a controller. The carrier comprises a position sensor and is configured for supporting a portion of the drape and receiving electric power from the electrically powered surface of the drapery rod. The controller is configured for supplying an electric power signal and a desired position command signal to the carrier via the electrically powered surface.

According to a second aspect, the present invention provides a drapery assembly for extending and retracting a drape. The drapery assembly includes a drapery rod comprising an electrically powered surface, a carrier held in movable linear mechanical restraint with the drapery rod, and a controller. The carrier comprises a position sensor and is configured for supporting a portion of the drape, receiving electric power from electrically powered surface, and transmitting position information to the electrically powered surface. The controller comprises a Power over Ethernet interface and is configured for receiving an electric power signal and a control input at the Power over Ethernet interface, supplying an electric power signal to the carrier via the electrically powered surface. The controller is also configured for transmitting a desired position command signal to the carrier via the electrically powered surface.

According to a third aspect, the present invention provides a drapery assembly for extending and retracting a drape. The drapery assembly includes a drapery rod comprising an electrically powered surface, a plurality of carriers, each being separately addressable and held in movable linear mechanical restraint with the drapery rod, and a controller. Each of the carriers comprises a position sensor and is configured for supporting a portion of the drape and receiving electric power from the electrically powered surface of the drapery rod. The controller is configured for transmitting a plurality of desired position command signals via the electrically powered surface. Each of the desired position command signals comprises and address and is associated with and corresponding to one the plurality of carriers.

BRIEF DESCRIPTION OF DRAWINGS

The accompanying figures further illustrate the present invention.

The components in the drawings are not necessarily drawn to scale, emphasis instead being placed upon clearly illustrating the principles of the present invention. In the drawings, like reference numerals designate corresponding parts throughout the several views.

BRIEF DESCRIPTION OF THE SEVERAL VIEWS OF THE DRAWING

Figure 1:
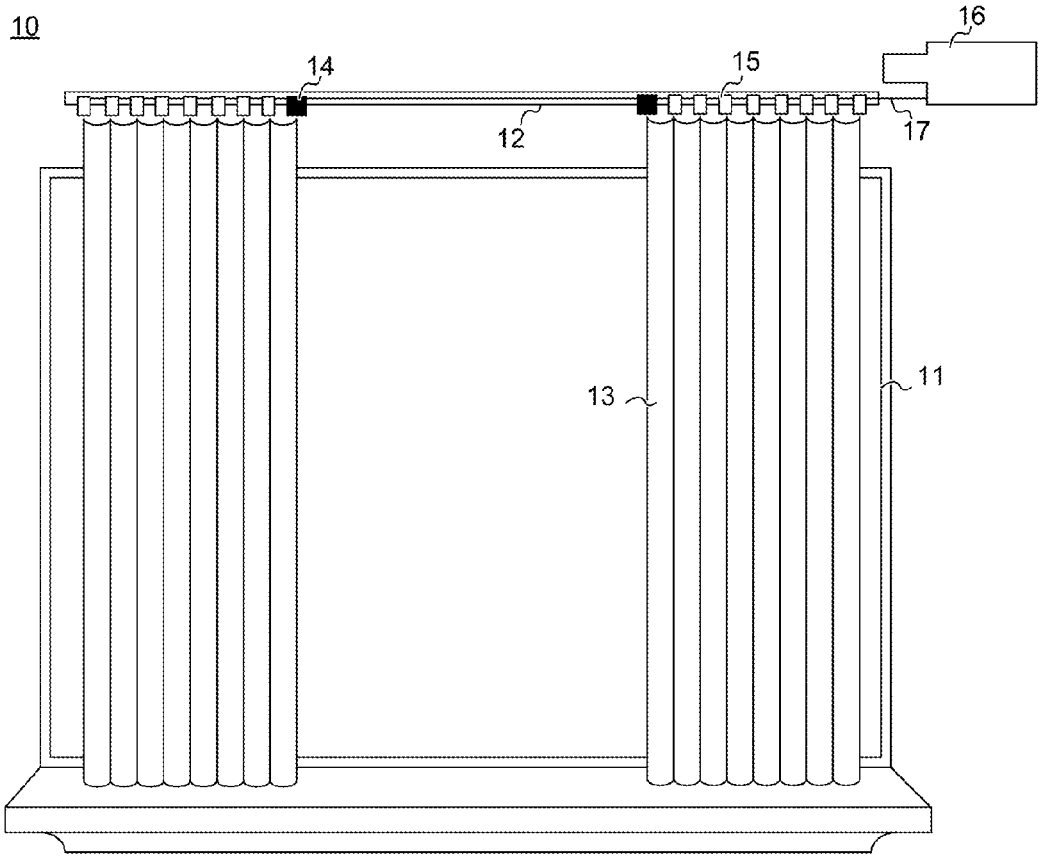
Prior Art FIG. 1

Prior Art FIG. 1 shows an illustrative drapery assembly known in the prior art.

Figure 2:
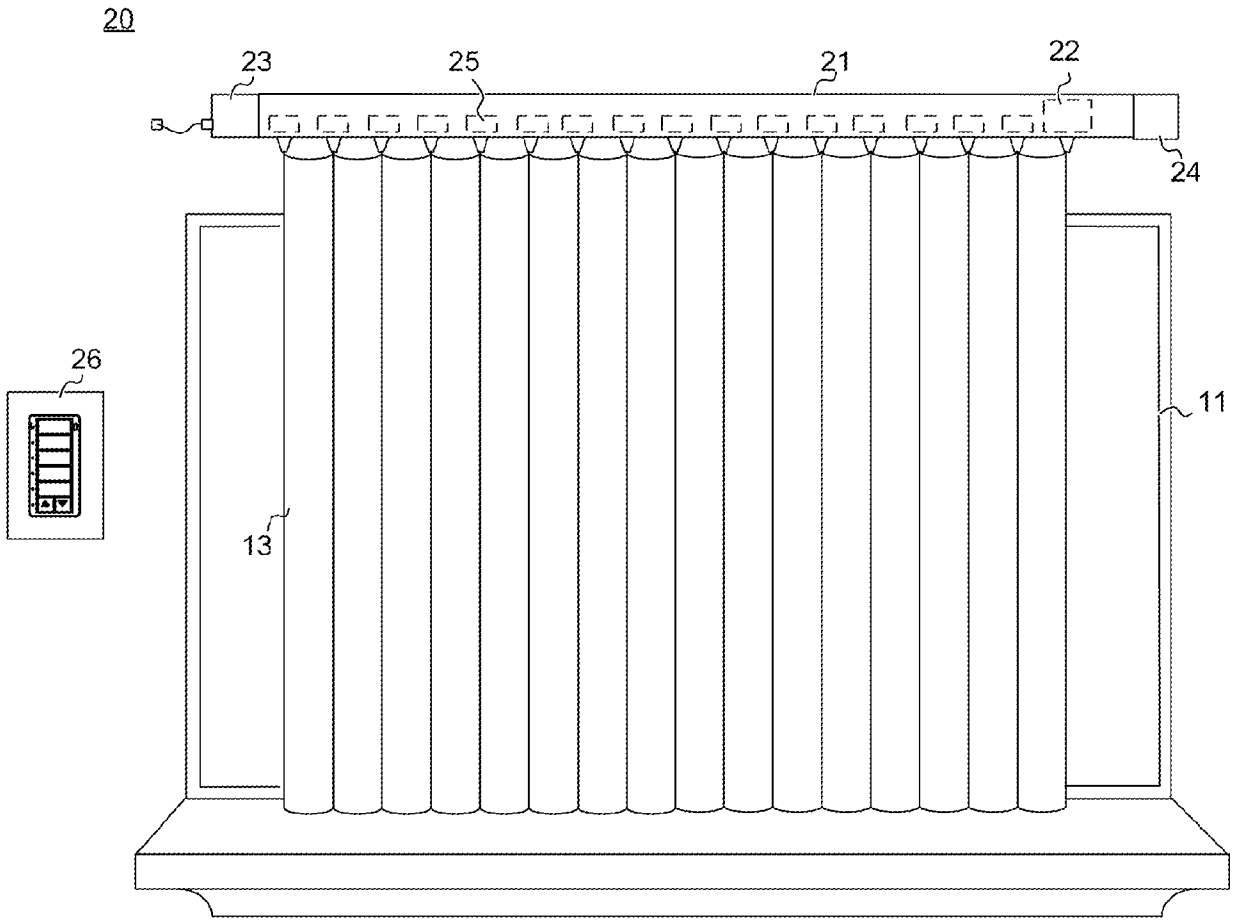

FIG. 2 shows an inventive drapery assembly according to an embodiment of the invention.

Figure 3:
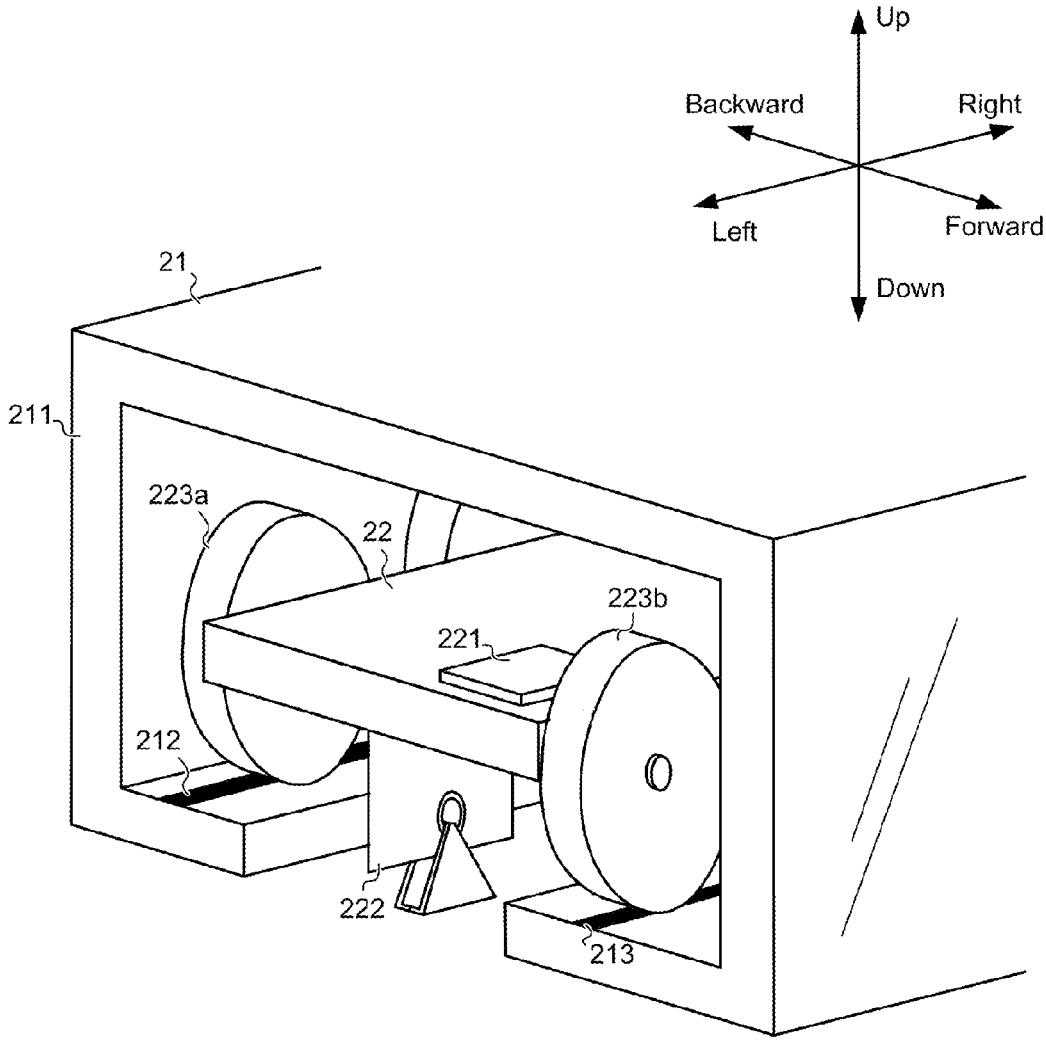

FIG. 3 shows a carrier and a cross section of a drapery rod suitable for use in the inventive drapery assembly.

Figure 4:
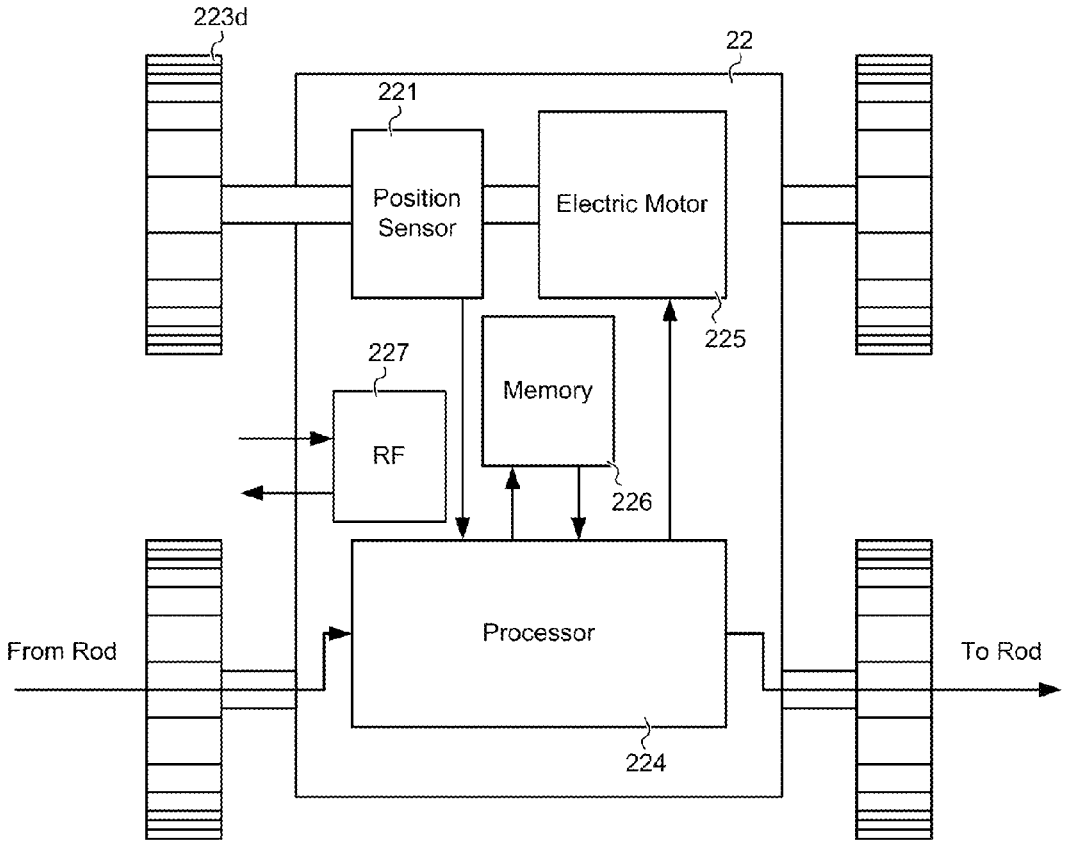

FIG. 4 is an illustrative block diagram of a carrier suitable for use in the inventive drapery assembly.

Figure 5:
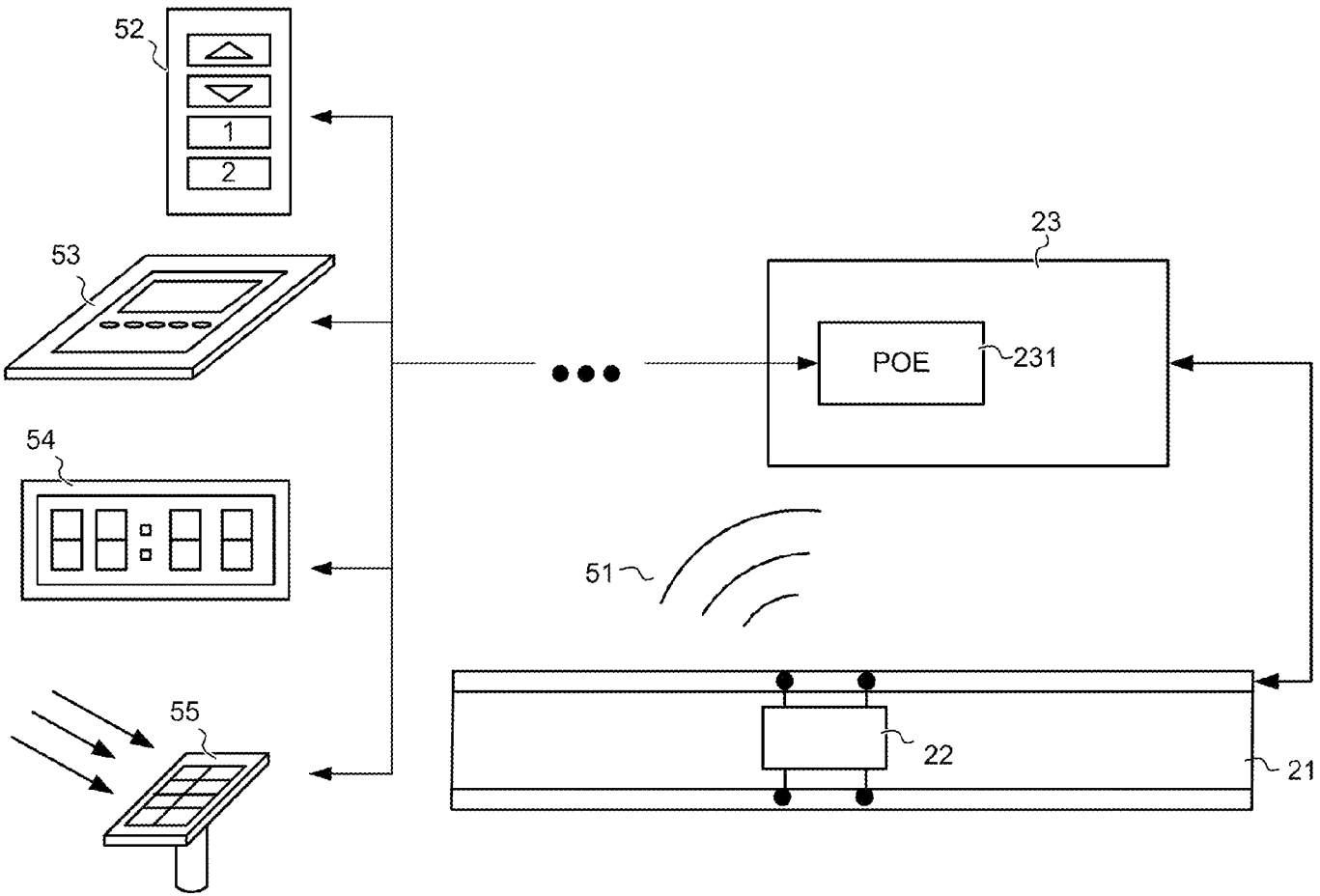

FIG. 5 is an illustrative block diagram of the inventive drapery assembly according to an embodiment of the invention.

Figure 6:
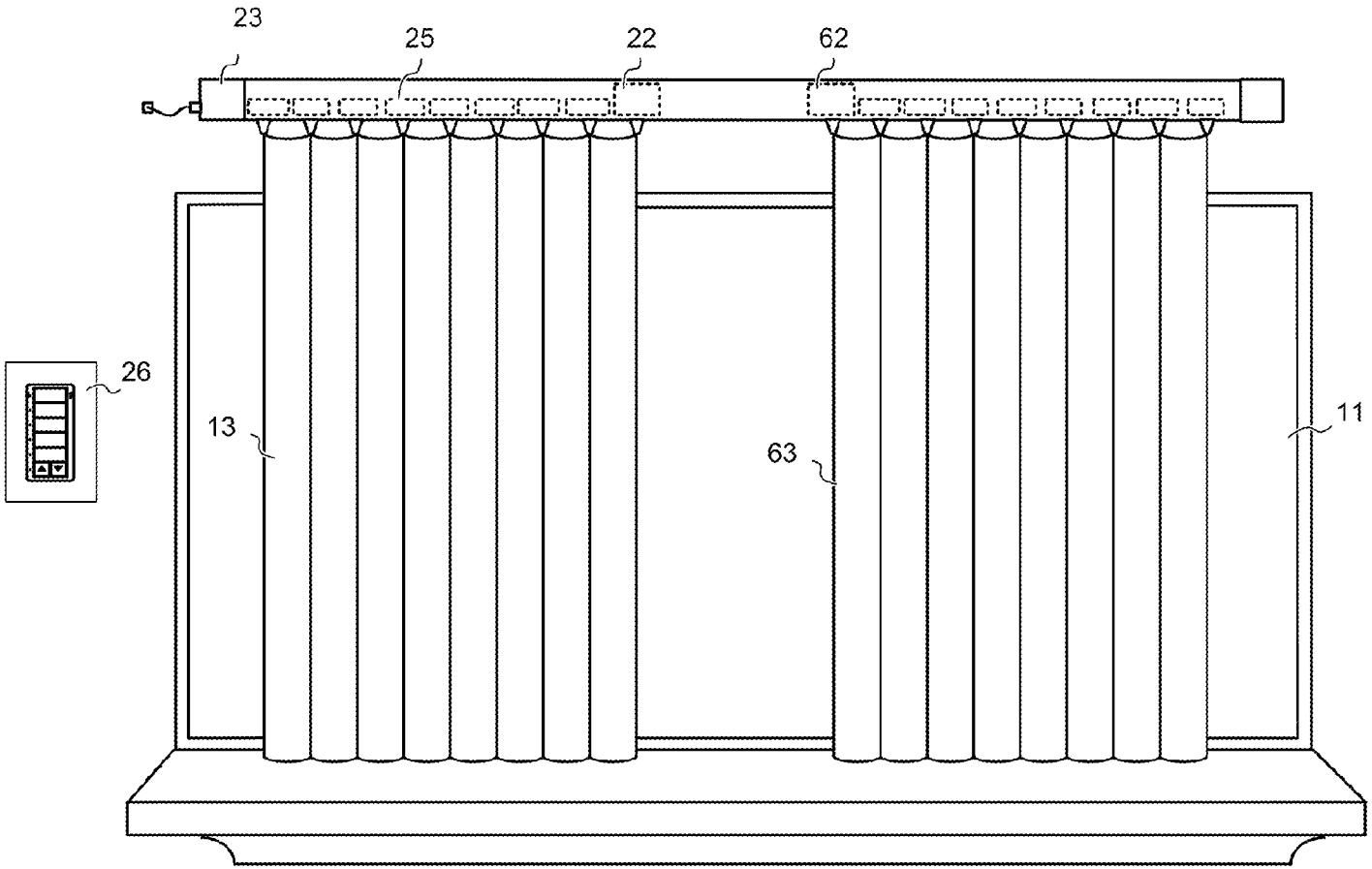

FIG. 6 shows the inventive drapery assembly with two carriers according to an embodiment of the invention.

Figure 7:
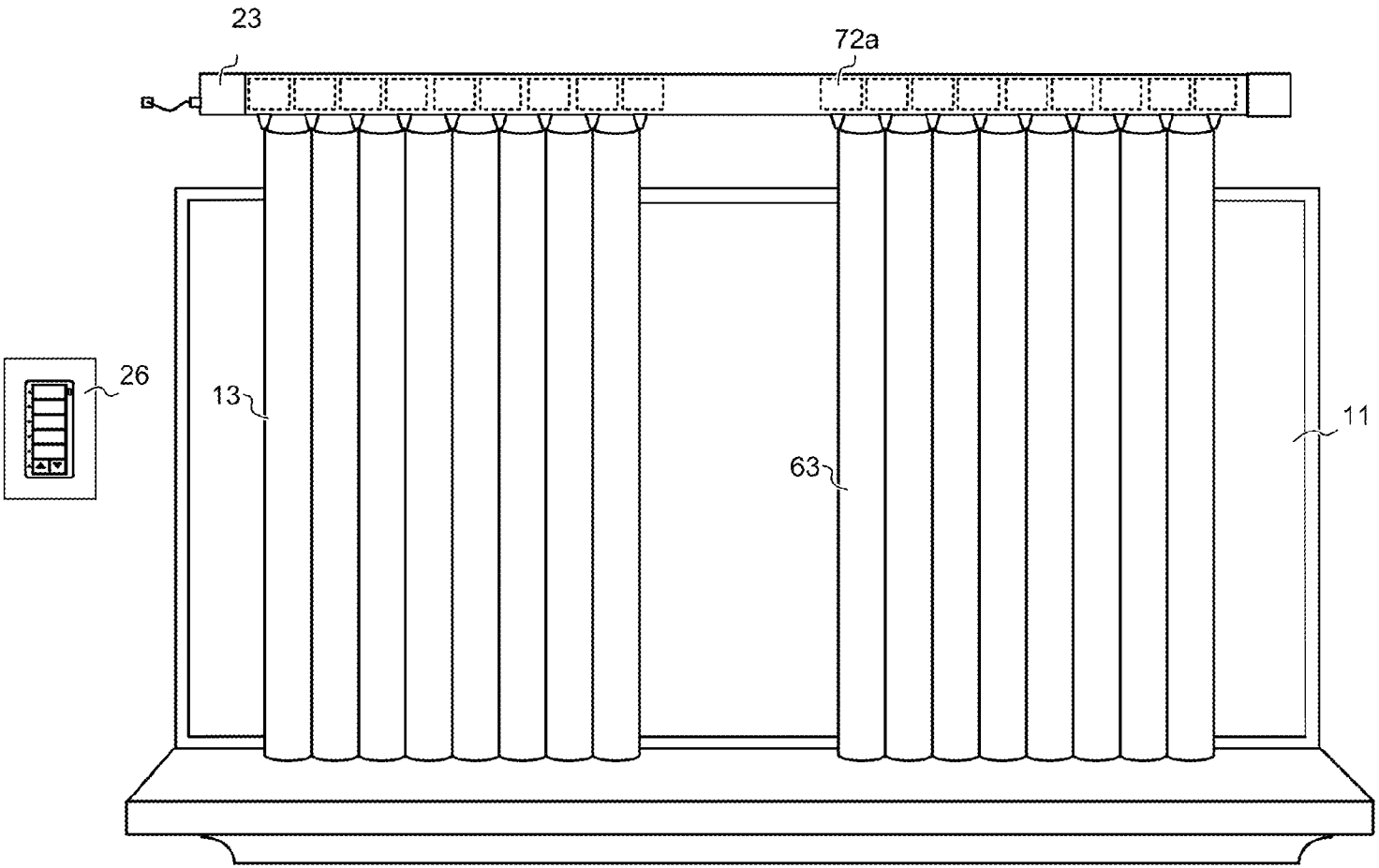

FIG. 7 shows the inventive drapery assembly with multiple carriers, each capable of being individually addressed, according to an embodiment of the invention.

Figure 8:
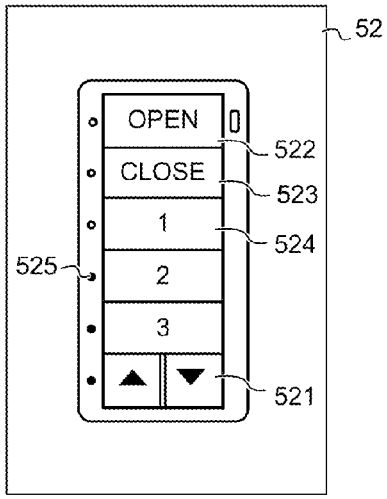

FIG. 8 shows a button panel suitable for transmitting a control input to a controller of the inventive drapery assembly.

Figure 9:
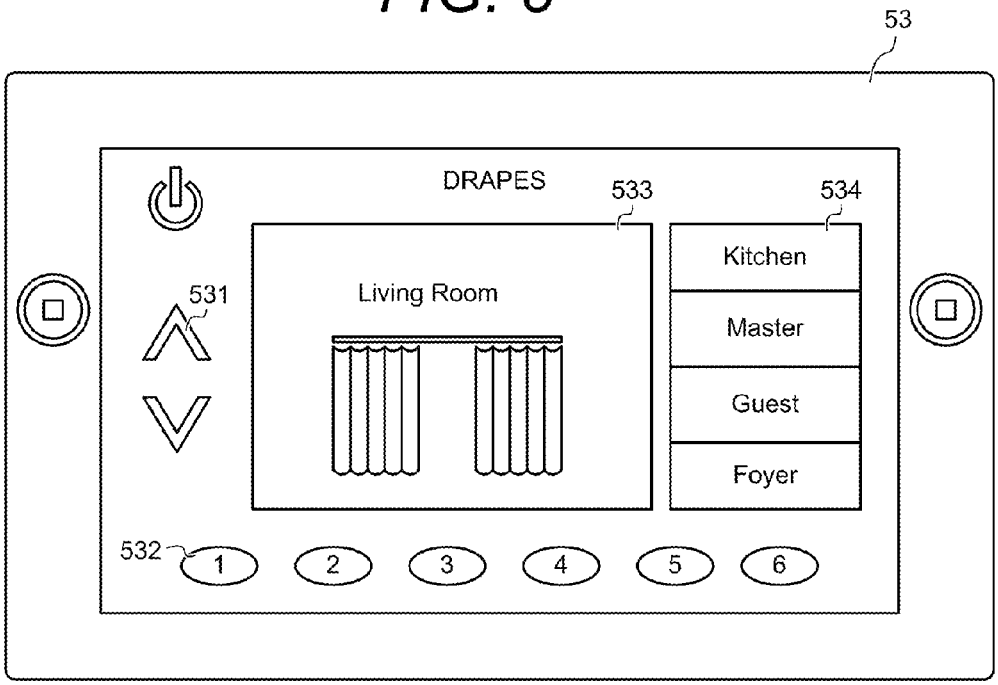

FIG. 9 shows a touchpanel suitable for transmitting a control input to a controller of the inventive drapery assembly.

LIST OF REFERENCE NUMBERS FOR THE MAJOR ELEMENTS IN THE DRAWING

The following is a list of the major elements in the drawings in numerical order.

| | |
|---|---|
| 10 | prior art drapery assembly |
| 11 | window |
| 12 | drapery rod |
| 13 | drape |
| 14 | primary carrier |
| 15 | secondary carrier |
| 16 | motor |
| 17 | drive cord |
| 20 | drapery assembly |
| 21 | drapery rod |
| 22 | carrier |
| 23 | controller |
| 24 | end cap |
| 25 | undriven carrier |
| 26 | external control point |
| 51 | wireless position signal |
| 52 | button panel |
| 53 | touchpanel |
| 54 | timer |
| 55 | light sensor |
| 62 | second carrier |
| 72a-n | addressable carrier |
| 82 | carrier |
| 211 | rectangular cross section |
| 212 | source path |
| 213 | return path |
| 221 | position sensor |
| 222 | connector |
| 223a-d | wheel |
| 224 | processor |
| 225 | electric motor |
| 226 | memory |
| 227 | RF transceiver |
| 231 | Power over Ethernet interface |
| 521 | extend/retract buttons |
| 522 | open button |
| 523 | close button |
| 524a-c | predefined position button |
| 525 | LED indicator |
| 531 | extend button |
| 532a-f | predefined position button |
| 533 | status display |
| 534 | drapery assembly selection button |

DETAILED DESCRIPTION OF THE INVENTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of the disclosure, are to be considered within the scope of the invention.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

MODE(S) FOR CARRYING OUT THE INVENTION

The present invention involves an inventive drapery assembly. More specifically, the present invention provides a drapery assembly that extends and retracts a drape by providing power and control information to one or more carriers through a drapery rod. Advantageously this allows for advanced control of the drapery assembly.

FIG. 2 is an illustrative diagram of an inventive drapery assembly 20 mounted above a drape covered window 11. The inventive drapery assembly 20 includes a drapery rod 21, a carrier 22 and a controller 23. The carrier 22 is held in movable linear mechanical restraint with drapery rod 21 and supports a portion of the drape 13 in space. The controller 23 provides both an electric power signal and a desired position command signal to the carrier 22 via an electrically powered surface of the drapery rod 21. In an embodiment of the invention, the controller 23 also serves as an end cap 24 of the drapery rod 21.

To extend and retract the drape 13, the carrier 22 moves linearly along the length of the drapery rod 21 according to the desired position command signal transmitted by the controller 23. In an embodiment of the invention, the controller transmits the desired position signal in response to receiving a control input, which may be provided by an external control point 26. Undriven carriers 25 also support portions of the drape 13, as necessary, and are pushed or pulled along the drapery rod 21 by the carrier 22.

In a further embodiment of the invention, the desired position command signal also comprises information pertaining to the desired speed of the carrier 22. The speed of the carrier 22 may be varied to account for circumstances or application. In some instances a smooth non-disruptive motion of the drape 13 is preferred. In other instances, the drape 13 may need to be closed suddenly. This is particularly useful in certain applications such as in a theatre where large drapes are opened and closed at various times and speeds for dramatic effect.

FIG. 3 shows a carrier 22 and a cross section of a drapery rod 21 suitable for use in the inventive drapery assembly 20, according to one embodiment of the invention. In this illustrative embodiment, the cross section 211 of the drapery rod 21 is a hollow rectangle with an unclosed bottom side. In this embodiment, the rectangular cross section 211 extends uniformly in a lateral direction forming a hollow rectangular rod with a slot opening running lengthwise along the bottom of the drapery rod 21. The bottom inner surface of the drapery rod 21 is electrically powered and comprises a source path 212 and a return path 213. The three remaining inner surfaces and the entire outer surface of the drapery rod 21 are not conductive.

In this embodiment, the carrier 22 fits substantially inside the hollow cavity of the drapery rod 21. The carrier 22 is free to move linearly in both directions along the length of the drapery rod 21 but is mechanically constrained from moving in either of the other two axes of motion (i.e forward/backward and up/down) with respect to the drapery rod 21. The carrier 22 additionally comprises a position sensor 221 to facilitate accurate movement along the rail. A connector 222 on the carrier 22 fits through a slot opening running the length of the bottom surface of the drapery rod 21 and is configured for connecting to the drape 13. The carrier 22 is conductively coupled to the electrically powered surface by at least two wheels in physical contact with the surface. A first wheel 223*a* is conductively coupled to the source path 212 and a second wheel 223*b* is conductively coupled to the return path 213.

In other embodiments, the drapery rod 21 may have a cross section that is non-uniform or of different dimensions. Alternatively, the drapery rod 21 may not follow a straight path and instead may follow a curved or twisted path. Additionally, the carrier 22 may couple to the drapery rod 21 in a different orientation. The carrier 22 may sit on top of the drapery rod 21, hang below the drapery rod 21 or substantially surround the drapery rod 21, so long as the carrier 22 is conductively coupled to the electrically powered surface and is held in movable linear mechanical restraint with the drapery rod 21.

FIG. 4 is an illustrative block diagram of a carrier 22 for use in the inventive drapery assembly 20. In embodiments of the invention, the carrier 22 further comprises a processor 224, an electric motor 225 and a memory 226. The processor 224 receives the electric power signal and the desired position command signal from the electrically powered surface of the drapery rod 21 and drives the electric motor 225 in response to the desired position command signal. The electric motor 225 in turn rotates at least one wheel 223*d* which provides the motive force required to move the carrier 22 linearly along the length of the drapery rod 21.

The memory 226 stores information accessible by the processor 224, including instructions for execution by the processor 224. The memory 226 may be of any type capable of storing information accessible by the processor 224. Data may be retrieved, stored or modified by the processor 224 in accordance with the instructions.

The carrier 22 further comprises a position sensor 346 for providing position information to the processor 224. For example, an optical encoder may count the rotations of the drive wheel and transmit position information to the processor 224 as a digital signal. The processor may then employ the position information as feedback for accurate control of the carrier 22.

Furthermore, in an embodiment of the invention, the carrier 22 transmits the position information to the controller 23 for feedback and display purposes via the electrically powered surface. FIG. 5 is an illustrative block diagram 50 of the inventive drapery assembly 20 according to an embodiment of the invention. In this embodiment, the controller 23 both transmits to and receives signals from the electrically powered surface of the drapery rod 21. The controller 23 transmits the electric power signal and a desired position command signal to the carrier 22 via the electrically powered surface of the drapery rod 21. The carrier 22 transmits position information to the controller 23 via the electrically powered surface of the drapery rod 21.

To avoid interference, the carrier transmits the position information to the controller at a frequency different frequency than the controller transmits the desired position signal to the carrier. For example, in an exemplary embodiment, the controller modulates the desired position command signal onto a direct current (DC) voltage signal at a first frequency, such as 100 kilohertz (kHz), and provides the modulated DC signal to the carrier 22 via the electrically powered surface of the drapery rod 21. The carrier 22 transmits the position information to the controller 23 via the electrically powered surface at a second frequency, such as 20 kHz.

In another embodiment of the invention, the carrier 22 further comprises an RF transceiver 227. The RF transceiver 227 is configured for transmitting a wireless position signal 51 comprising the position information to the controller 23 or an external control point 26 via a wireless communication channel.

In an embodiment of the invention, the controller 23 transmits the desired position command signal in response to receiving a control input. The control input received by the controller 23 may be a direct user input to the controller 23 or a wired or wireless signal from an external control point 26, such as a button panel 52 or touchpanel 53. For example, the controller 23 may receive a control input from a wall-mounted button panel 52 in response to a button actuation or similar action by the user.

The control input may also originate from a signal generator such as a timer 54 or a sensor 55. In an embodiment of the invention, a timer 54 is configured for transmitting a control input to the controller 23 at a predetermined time. The timer 54 may be set according to personal preferences or for security reasons. In another embodiment, a light sensor 55 is configured for transmitting a control input to the controller 23 in response to sensing a predetermined level of sunlight.

In embodiments of the invention, the controller 23 comprises a Power over Ethernet (PoE) interface 231. The controller 23 receives both the electric power signal and the control input from a network through the PoE interface 231. For example, the Power over Ethernet interface may be connected through category 5 cable (CAT 5) to a local area network (LAN) which contains both a power supply and multiple control points and signal generators. Additionally, through PoE interface controller 23 may interface with the internet and receive control inputs remotely, such as from a homeowner running an application on a smart phone.

The controller may also provide information to the network through the PoE interface. For example, the controller may transmit this position information received from the carrier 22 to external control points 26. In an embodiment of the invention in which the controller is connected to the Internet, the controller may transmit position information to a device in a remote location.

FIG. 6 shows an embodiment of the invention in which the drapery assembly 20 is a double drapery assembly. In double drape assemblies a second carrier 62 is also held in movable linear mechanical restraint with drapery rod 21 and supports a portion of a second drape 63 in space. The second carrier 62 is configured to receive the electric power signal and the desired position command signal from the controller 23 via the electrically powered surface of the drapery rod 21 and is further configured to move along the drapery rod 21 an equal magnitude but opposite direction as that of the original carrier 22 in response to the desired position command signal.

FIG. 7 shows an embodiment of the invention in which the drapery assembly extends and retracts a first drape 13 and second drape 63 and comprises a drapery rod with an electrically powered surface, multiple carriers 72*a-n*, each configured for being separately addressed, and a controller. Each of the carriers 72 is held in movable linear mechanical restraint with the drapery rod 21 and supports a portion of the first or second drape 13, 63. The controller 23 provides an electric power signal and a plurality of desired position command signals to the carriers 72 via the electrically powered surface of the drapery rod 21. Each of the desired position command signals is associated with a corresponding carrier 72 and comprises an address.

Each carrier 72 moves linearly along the length of the drapery rod 21 according to its corresponding desired position command signal, thereby extending and retracting the drapes 13, 63. Each carrier 72 additionally comprises a position sensor to facilitate accurate movement along the rail.

Advantageously, the plurality of carriers 72 allows for coordinated movement of and increased control options for the drapery assembly. For example, in one exemplary and non-limiting embodiment, the desired position command signals are configured to facilitate controlled and uniform movement of the carriers along the drapery rod 21. Instead of all carriers 72 travelling at the same speed and arriving at each corresponding desired position at different times, the motion of the carriers 72 is coordinated so that all carriers 72 begin movement and cease movement at substantially the same time.

Providing a plurality of carriers 72, capable of being individually addressed allows for multiple drapes to be supported and controlled along a single drapery rod 21 without any complicated mechanical connections. The extension and retraction of two drapes 13, 63 in a double drapery assembly is coordinated through the plurality of desired position command signals from the controller 23. Similarly, more than two drapes may be extended and retracted through the transmission of desired position command signals from the controller 23.

Furthermore, multiple carriers 72, each capable of being individually addressed, may be distributed on more than drapery rod, each including an electrically powered surface and in communication with the controller 23. Each of the carriers 72 further comprise a position sensor and are held in movable linear mechanical restraint with their respective drapery rod. The controller 23 is further configured to transmit an electric power signal and a plurality of desired position command signals to the carriers 72 via the electrically powered surface of the plurality of drapery rods. Advantageously, the controller 23 may coordinate the extension and retraction of multiple drapes throughout an environment.

FIGS. 8 and 9 show two external control points suitable for providing a control input to the controller, such as through a LAN connected to the controller via the power over Ethernet interface 231. The wall mounted button panel 52 provides a control input to the controller in response to button actuations by a user. The buttons may correspond to an analog control such as "extend" or "retract" buttons 521. The buttons may also correspond to predefined positions of the drape such as the "open" 522 and "close" 523. Buttons "1", "2" and "3" 524 may correspond to predefined positions of the shade between open and close.

Alternatively buttons "1" and "2" 524 may correspond to a room setting of which the shade position is one variable. For example, button "1" may correspond to a predefined setting for a dinner party. Button 1 may be programmed to dim lights, light a fireplace and fully open the shades. Button "2" may correspond to a predefined setting for vacation in which the lights are shut off and the shades are fully closed. The wireless touchpanel 53 also includes buttons 534 for selecting various shades to control, in addition to the extend, retract 531, and predefined position buttons 532.

In addition to providing control inputs, the control points shown in FIG. 8 and FIG. 9 are capable of displaying the status of the drape as determined from position information transmitted by the carrier 22. For example, light emitting diodes (LEDs) 525 disposed on the wall mounted button panel may indicate the current position of the shade. Half lit LEDs may indicate that the shade is half closed. In another example, the status of the shade as determined from the position information may be displayed graphically on the graphic user interface (GUI) 533 of a wireless touchpanel. The LEDs 525 and GUI 533 may indicate the current command inputted to the controller.

INDUSTRIAL APPLICABILITY

To solve the aforementioned problems, the present invention is a unique system in which a carrier or a plurality of carriers extend and retract a drape upon receiving electric power and a command signal from a drapery rod 21.

LIST OF ACRONYMS USED IN THE DETAILED DESCRIPTION OF THE INVENTION

The following is a list of the acronyms used in the specification in alphabetical order.

| | |
|---|---|
| CAT 5 | category 5 |
| DC | direct current |
| GUI | graphic user interface |

-continued

| | |
|---|---|
| kHz | kilohertz |
| LED | light emitting diode |
| PoE | power over Ethernet |

ALTERNATE EMBODIMENTS

Alternate embodiments may be devised without departing from the spirit or the scope of the invention. For example, the drapery rod may have a generally rounded cross section.

What is claimed is:

1. A drapery assembly for extending and retracting a drape, said drapery assembly comprising:

(a) a drapery rod comprising an electrically powered surface;

(b) a carrier being held in movable linear mechanical restraint with the drapery rod and comprising a position sensor, said carrier configured for supporting a portion of the drape and receiving electric power from the electrically powered surface, the carrier further comprising:

(i) a processor for receiving an electric power signal and a desired position command signal, (ii) an electric motor, said electric motor controlled by the processor according to the desired position command signal, and (iii) a memory for storing information used by the processor in controlling the electric motor; and (c) a controller, said controller configured for (i) supplying the electric power signal to the carrier via the electrically powered surface, and (ii) transmitting the desired position command signal to the carrier via the electrically powered surface.

2. The drapery assembly of claim 1 wherein the controller provides the desired position command signal to the carrier in response to receiving a control input.

3. The drapery assembly of claim 2 wherein the controller receives the control input from a signal generator.

4. A drapery assembly for extending and retracting a drape, said drapery assembly comprising:

(a) a drapery rod comprising an electrically powered surface;

(b) a carrier being held in movable linear mechanical restraint with the drapery rod and comprising a position sensor, said carrier configured for:

(i) supporting a portion of the drape, and (ii) receiving electric power from the electrically powered surface;

(c) a controller, said controller configured for (i) supplying the electric power signal to the carrier via the electrically powered surface, and (ii) transmitting a desired position command signal to the carrier via the electrically powered surface in response to receiving the control input; and (d) wherein the carrier is further configured for transmitting position information to the controller via the electrically powered surface of the drapery rod.

5. The drapery assembly of claim 4 wherein the carrier further comprises an RF transceiver and is further configured for transmitting a wireless position signal.

6. The drapery assembly of claim 4 further comprising an external control point configured for:

(a) transmitting the control input to the controller and receiving position information from the controller; and (b) displaying the status of the drape as determined from said position information.

7. A drapery assembly for extending and retracting a drape, said drapery assembly comprising:

(a) a drapery rod comprising an electrically powered surface;

(b) a carrier being held in movable linear mechanical restraint with the drapery rod and comprising a position sensor, said carrier configured for (i) supporting a portion of the drape, (ii) receiving electric power from the electrically powered surface, and (iii) transmitting position information to the electrically powered surface; and (c) a controller configured as an end cap of the drapery rod and comprising a Power over Ethernet interface, said controller configured for (i) receiving an electric power signal and a control input at the Power over Ethernet interface, (ii) supplying an electric power signal to the carrier via the electrically powered surface, and (iii) transmitting a desired position command signal to the carrier via the electrically powered surface and according to the received control input.

8. The drapery assembly of claim 7 wherein the carrier further comprises:

(a) a processor for receiving the electric power signal and the desired position command signal;

(b) an electric motor, said electric motor controlled by the processor according to the desired position command signal; and (c) a memory for storing information used by the processor in controlling the electric motor.

9. The drapery assembly of claim 7 wherein the control input is generated by a signal generator.

10. The drapery assembly of claim 7 further comprising an external control point configured for:

(a) transmitting the control input and receiving position information from the controller; and (b) displaying the status of the drape as determined from said position information.

11. A drapery assembly for extending and retracting a drape, said drapery assembly comprising:

(a) a drapery rod comprising an electrically powered surface;

(b) a plurality of carriers being held in movable linear mechanical restraint with the drapery rod, (i) each of said carriers being separately addressable and comprising a position sensor, (ii) each of said carriers configured for supporting a portion of the drape, (iii) each of said carriers configured for receiving electric power from the electrically powered surface; and (c) a controller, said controller configured for (i) supplying an electric power signal to the carriers via the electrically powered surface, (ii) transmitting a plurality of desired position command signals to the carriers via the electrically powered surface, each of said desired position command signals associated with a corresponding one of said plurality of carriers and comprising an address thereof.

12. The drapery assembly of claim 11 wherein each carrier further comprises:

(a) a processor for receiving the electric power signal and the plurality of desired position command signals;

(b) an electric motor, said electric motor controlled by the processor according to a correspondingly addressed desired position command signal; and (c) a memory for storing information used by the processor in controlling the electric motor.

13. The drapery assembly of claim 11 wherein the controller provides the desired position command signals to the carrier in response to receiving a control input.

14. The drapery assembly of claim 13 wherein the controller further comprises a Power over Ethernet (PoE) interface for receiving the control input and the electric power signal.

15. The drapery assembly of claim 13 wherein the controller receives the control input from a signal generator.

16. The drapery assembly of claim 13 further comprising an external control point configured for:

(a) transmitting the control input to the controller and receiving position information from the controller; and (b) displaying the status of the drape as determined from said position information.

17. The drapery assembly of claim 11 wherein each carrier is further configured for transmitting position information to the controller via the electrically powered surface of the drapery rod.

18. A drapery assembly for extending and retracting a drape, said drapery assembly comprising:

(a) a drapery rod comprising an electrically powered surface;

(b) a carrier being held in movable linear mechanical restraint with the drapery rod and comprising a position sensor, said carrier configured for:

(i) supporting a portion of the drape, and (ii) receiving electric power from the electrically powered surface; and (c) a controller comprising a Power over Ethernet interface for receiving a control input and an electric power signal, said controller configured for (i) supplying the electric power signal to the carrier via the electrically powered surface, and (ii) transmitting a desired position command signal to the carrier via the electrically powered surface in response to receiving the control input.

* * * * *